US008456403B2

(12) United States Patent
Jang et al.

(10) Patent No.: US 8,456,403 B2
(45) Date of Patent: Jun. 4, 2013

(54) LIQUID CRYSTAL DISPLAY AND DRIVING METHOD THEREOF

(75) Inventors: Suhyuk Jang, Daegu (KR); Yangseok Jeong, Gyeonggi-do (KR); Songjae Lee, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 727 days.

(21) Appl. No.: 12/556,680

(22) Filed: Sep. 10, 2009

(65) Prior Publication Data

US 2010/0164940 A1 Jul. 1, 2010

(30) Foreign Application Priority Data

Dec. 26, 2008 (KR) ..... 10-2008-0134694

(51) Int. Cl.
*G09G 3/36* (2006.01)

(52) U.S. Cl.
USPC ..... 345/96; 345/87; 345/90; 345/99; 345/214; 345/618

(58) Field of Classification Search
None
See application file for complete search history.

(56) References Cited

U.S. PATENT DOCUMENTS

| | | | | |
|---|---|---|---|---|
| 2001/0004253 | A1* | 6/2001 | Fukutoku et al. | 345/96 |
| 2004/0178981 | A1 | 9/2004 | Asada et al. | |
| 2008/0088615 | A1 | 4/2008 | Chen et al. | |
| 2009/0121997 | A1* | 5/2009 | Jo | 345/99 |

FOREIGN PATENT DOCUMENTS

| | | | |
|---|---|---|---|
| KR | 10-2004-0068251 | A | 7/2004 |
| WO | WO 2008/150855 | A1 | 12/2008 |

OTHER PUBLICATIONS

United Kingdom Office Action dated Apr. 27, 2011.

KIPO—Office Action for Korean Patent Application No. 10-2008-0134694—Issued on Mar. 26, 2013.

* cited by examiner

*Primary Examiner* — Joseph Haley

*Assistant Examiner* — Ifedayo Iluyomade

(74) *Attorney, Agent, or Firm* — Morgan, Lewis & Bockius LLP

(57) ABSTRACT

A liquid crystal display and a driving method thereof are provided. The liquid crystal display includes: a liquid crystal display panel including a plurality of data lines, a plurality of gate lines crossing the data lines, and pixels arranged in m×n matrix; a register for defining polarity pattern information, frame rotation information, and line rotation information to determine a polarity of a data voltage charged in N lines, wherein N is a positive integer less than n; a timing controller for generating a polarity control signal to control polarities of data voltages charged in n lines of the liquid crystal display panel based on the information read from the register; and source drive ICs for converting the polarities of the data voltages supplied to the data lines in response to the polarity control signal.

6 Claims, 4 Drawing Sheets

FIG. 3

| Item | | Enter Value | Hex | ROM |
|---|---|---|---|---|
| Vertical POL | 1 Frame POL (REPEAT) | 1 | FF | FF |
| | | 1 | | |
| | | 1 | | |
| | | 1 | | |
| | | 1 | | |
| | | 1 | | |
| | | 1 | | |
| | | 1 | | |
| | | 1 | 5F | 5F |
| | | 1 | | |
| | | 1 | | |
| | | 1 | | |
| | 2 Frame POL (REPEAT) | 1 | | |
| | | 0 | | |
| | | 1 | | |
| | | 0 | | |
| | | 1 | 55 | 55 |
| | | 0 | | |
| | | 1 | | |
| | | 0 | | |
| | | 1 | | |
| | | 0 | | |
| | | 1 | | |
| | | 0 | | |
| | 3 Frame POL | 0 | 00 | 00 |
| | | 0 | | |
| | | 0 | | |
| | | 0 | | |
| | | 0 | | |
| | | 0 | | |
| | | 0 | | |
| | | 0 | | |
| | | 0 | A0 | A0 |
| | | 0 | | |
| | | 0 | | |
| | | 0 | | |
| | 4 Frame POL | 0 | | |
| | | 1 | | |
| | | 0 | | |
| | | 1 | | |
| | | 0 | AA | AA |
| | | 1 | | |
| | | 0 | | |
| | | 1 | | |
| | | 0 | | |
| | | 1 | | |

LIQUID CRYSTAL DISPLAY AND DRIVING METHOD THEREOF

This application claims the benefit of Korean Patent Application No. 10-2008-0134694 filed on Dec. 26, 2008, which is incorporated herein by reference for all purposes as it fully set forth herein.

BACKGROUND OF THE INVENTION

1. Field of the Invention

This document relates to a liquid crystal display and a driving method thereof.

2. Discussion of the Related Art

Flat panel displays include a liquid crystal display (LCD), a field emission display (FED), a plasma display panel (PDP), an organic light emitting display (OLED), etc.

Since the LCD satisfies the trend toward lightweight, thin, short and small electric appliances and has improved mass productivity, cathode ray tubes have been rapidly replaced with LCDs in many applications. An active matrix type LCD which drives liquid crystal cells using thin film transistors (hereinafter, referred to as "TFTs") has been rapidly developed to realize an increase in size and a high resolution by a recent mass production technology and the results of research and development and has been quickly replacing cathode ray tubes in many applications.

A liquid crystal display is driven in an inversion method for inverting the polarities of data voltages charged in a liquid crystal display panel in a predetermined pattern in order to prevent degradation of liquid crystal. However, a data voltage charged in the liquid crystal display panel is biased toward one polarity or another according to the correlation between an image pattern input to the liquid crystal display and a polarity pattern of the liquid crystal display panel, and a common voltage shift is generated due to the biased polarity, thereby degrading display quality.

A pattern of an input image that degrades the display quality in the liquid crystal display may be defined as a problem pattern (or weak pattern), and problem pattern images include an image having white data and black data alternating in subpixels, an image having white data and black data alternating in pixels, a crosstalk check pattern containing a white display surface in a black background, and so on. In addition, the problem pattern includes interlace data in which odd-numbered line data and even-numbered line data are separated.

The present applicant proposed a method for compensating for a biased polarity of a data voltage or a common voltage shift by changing polarity control signals for controlling the polarity of a data voltage charged in a liquid crystal display panel upon input of an image of a problem pattern in Korean Patent Application 10-2007-0052679 (2007-05-30), Korean Patent Application 10-2008-0055419 (2008-06-12), and Korean Patent Application 10-2008-0032638 (2008-04-08). As a result of applying the previously filed applications to a liquid crystal display, degradation of display quality in an image of a problem pattern can be prevented. However, if a pixel array structure of the liquid crystal display panel is changed, the problem pattern image that degrades the display quality of the liquid crystal display panel is also changed. When the problem pattern image is changed due to a change in the pixel array structure, the polarity pattern of the liquid crystal display panel therefore should be changed.

Accordingly, there is a demand for a method which is capable of adaptively changing a problem pattern image, which is defined differently according to a model of a liquid crystal display, and a polarity pattern of a liquid crystal display panel for preventing degradation of the display quality in the problem pattern image. Furthermore, an algorithm and circuit for implementing an adaptive polarity pattern controlling method has to be implemented in a manner that requires no large-capacity memory.

SUMMARY OF THE INVENTION

Accordingly, the present invention has been made to solve the above-mentioned problems occurring in the prior art, and an aspect of the present invention is to provide a liquid crystal display, which can change a polarity pattern of a liquid crystal display panel adaptively to various problem patterns without using an additional memory, and a method for driving the same.

To achieve the above aspect, there is provided a liquid crystal display according to the present invention, including: a liquid crystal display panel including a plurality of data lines, a plurality of gate lines crossing the data lines, and pixels arranged in m×n matrix, wherein m and n are positive integers; a register for defining polarity pattern information, frame rotation information, and line rotation information to determine a polarity of a data voltage charged in N lines, wherein N is a positive integer less than n; a timing controller for generating a polarity control signal to control polarities of data voltages charged in n lines of the liquid crystal display panel based on the informations read from the register; and source drive ICs for converting the polarities of the data voltages supplied to the data lines in response to the polarity control signal.

There is provided a driving method of a liquid crystal display according to the present invention, including: defining polarity pattern information, frame rotation information, and line rotation information to determine a polarity of a data voltage charged in N lines, wherein N is a positive integer less than n; generating a polarity control signal to control polarities of data voltages charged in n lines of the liquid crystal display panel based on the information read from the register; and converting the polarities of the data voltages supplied to the data lines in response to the polarity control signal.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 3 is a view showing an example of setting polarity pattern information of an EEPROM which transmits the polarity pattern information to the timing controller through $I^2C$ communication.

DETAILED DESCRIPTION

The above and other aspects and features of the present invention will become more apparent by describing exemplary embodiments thereof with reference to the attached drawings.

Hereinafter, an implementation of this document will be described in detail with reference to FIGS. 1 to 4.

Figure 1:
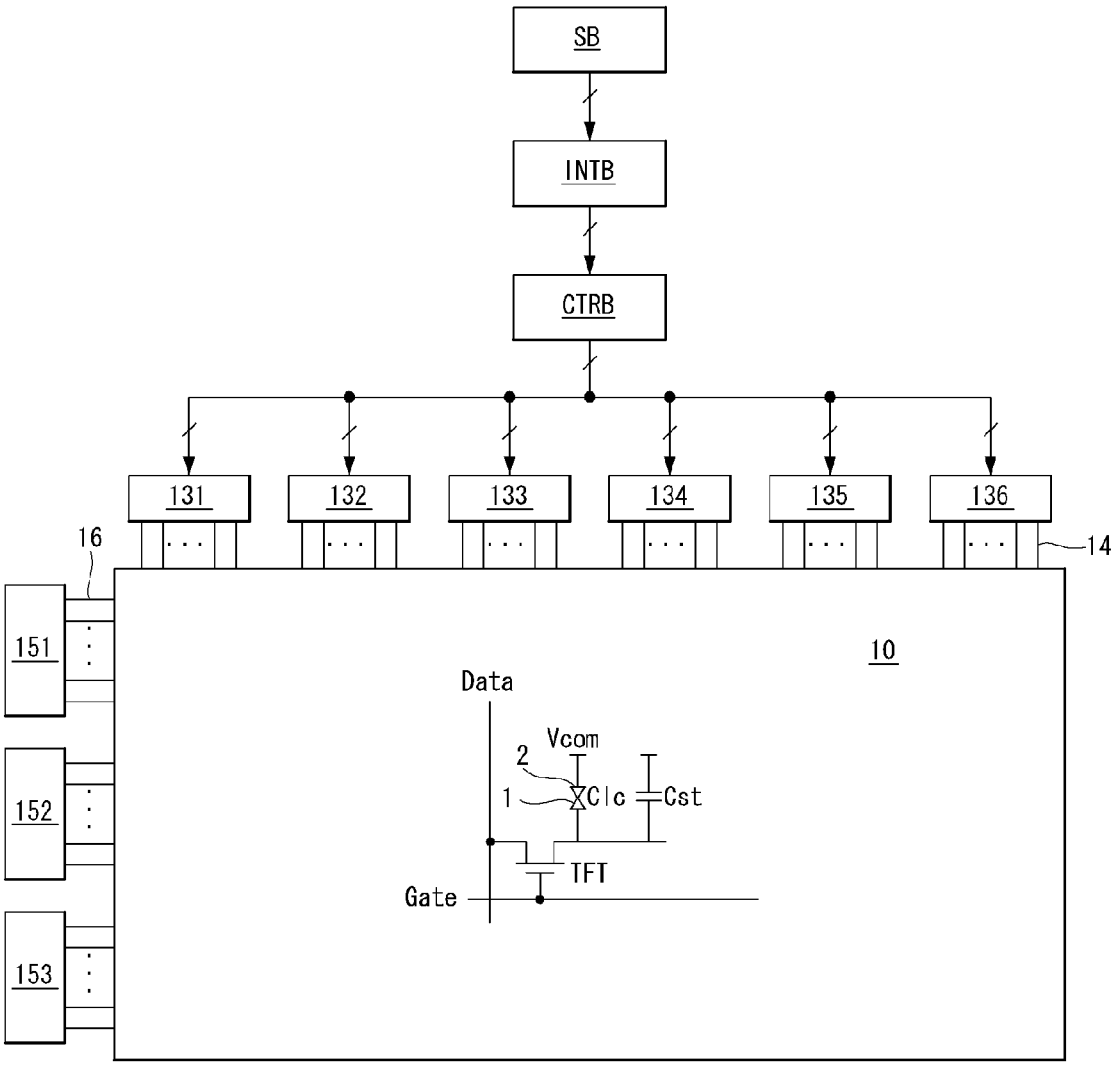
FIG. 1 is a block diagram showing a liquid crystal display according to an exemplary embodiment of the present invention.

Referring to FIG. 1, a liquid crystal display according to an exemplary embodiment of the present invention includes a liquid crystal display panel 10, a plurality of gate drive integrated circuits (ICs) 151 to 153, a plurality of source drive integrated circuits (ICs) 131 to 136, a system board SB, an interface board INTB, and a control board CTRB.

In the liquid crystal display panel 10, a liquid crystal layer is formed between two glass substrates. Liquid crystal cells of the liquid crystal display panel 10 are disposed in a matrix at crossings of data lines 14 and gate lines 16. On the lower glass substrate of the liquid crystal display panel 10, a pixel array including data lines 14, gate lines 16, TFTs, liquid crystal cells Clc connected to the TFTs and driven by an electric field between pixel electrodes 1 and common electrodes 2, storage capacitors Cst, and the like, is formed. Black matrixes, color filters, etc. are formed on the upper glass substrate of the liquid crystal display panel 10. The common electrodes 2 are formed on the upper glass substrate to implement a vertical electric field driving method, such as a twisted nematic (TN) mode or a vertical alignment (VA) mode, and formed on the lower glass substrate together with the pixel electrodes 1 to implement a horizontal electric field driving method, such as an in-plane switching (IPS) mode or a fringe field switching (FFS) mode. Polarizers on which optical axes are perpendicular to each other are attached on the upper and lower glass substrates of the liquid crystal display panel 10, and alignment films are formed at an interface contacting liquid crystal to set a pre-tilt angle for the liquid crystal.

The liquid crystal mode of the liquid crystal display panel 10 applicable in the present invention may be implemented as any liquid crystal mode, as well as the above-stated TN mode, VA mode, IPS mode, and FFS mode. Moreover, the liquid crystal display of the present invention may be implemented in any form including a transmissive liquid crystal display, a semi-transmissive liquid crystal display, and a reflective liquid crystal display. The transmissive liquid crystal display and the semi-transmissive liquid crystal display require a backlight unit which is omitted in the drawings.

The source drive ICs 131 to 136 receive digital video data transmitted by a mini LVDS method, from the control board CTRB, converts the data into analog data voltages in response to a source timing control signal from the control board CTRB, and supplies the data to the data lines 14 of the liquid crystal display panel 10.

Each of the gate drive ICs 151 to 153 generates a gate pulse (or scan pulse) in response to a gate timing control signal from the control board CTRB and sequentially supplies the gate pulse to the gate lines 16.

The system board SB includes a scaler circuit for adjusting the resolution of the digital video data, and sends timing signals, along with the digital video data, to the interface board INTB. The timing signals include vertical and horizontal synch signals Vsync and Hsync, a data enable signal DE, and a dot clock signal DCLK.

The interface board INTB transmits the digital video data and timing signals input from the system board SB to the control board CTRB via a low-voltage differential signaling (LVDS) interface or a transition minimized differential signaling (TMDS) interface.

The control board CTRB is equipped with a timing controller, a register, an EEPROM (electrically erasable and programmable ROM), etc. The register may be embedded in the timing controller. The register defines a problem pattern and a resultant vertical/horizontal polarity pattern. A LCD maker or TV/monitor set maker may modify, add, and delete the problem pattern and polarity pattern stored in the register via a cable and connector. The timing controller TCON generates a source timing control signal for controlling the operation timing of the source drive ICs 131 to 136 and a gate timing control signal for controlling the operation timing of the gate drive ICs 151 to 153 by using the timing signals received through the interface board INTB.

The source timing control signals include a source start pulse SSP, a source sampling clock SSC, a vertical polarity control signal POL, a horizontal polarity control signal H1/H2DOT, a source output enable signal SOE, etc. The source sampling clock SSC is a clock signal which controls a data sampling operation in the source drive ICs 131 to 136 based on a rising or falling edge. The vertical polarity control signal POL controls the vertical polarity of a data voltage output from the source drive ICs 131 to 136. The horizontal polarity control signal H1/H2DOT controls the horizontal polarity of a data voltage output from the source drive ICs 131 to 136. The source output enable signal SOE controls the output timing of the source drive ICs 131 to 136. If digital video data and a mini LVDS clock are transmitted between the timing controller TCON and the source drive ICs 131 to 136 in accordance with a mini LVDS scheme, a first clock generated after a reset signal of the mini LVDS clock serves as a start pulse. Thus, the source start pulse SSP may be omitted.

The gate timing control signals include a gate start pulse GSP, a gate shift clock signal GSC, a gate output enable signal GOE, etc. The gate start pulse GSP is applied to the first gate drive IC 151 for generating a first gate pulse (or scan pulse). The gate shift clock GSC is commonly input to the gate drive ICs 151 to 153 to shift the gate start pulse GSP. The gate output enable signal GOE controls outputs of the gate drive ICs 151 to 153.

The timing controller TCON reads out polarity pattern information from the register, and generates a vertical polarity control signal POL while repetitively counting the read polarity pattern information for each frame and each line.

Figure 2:
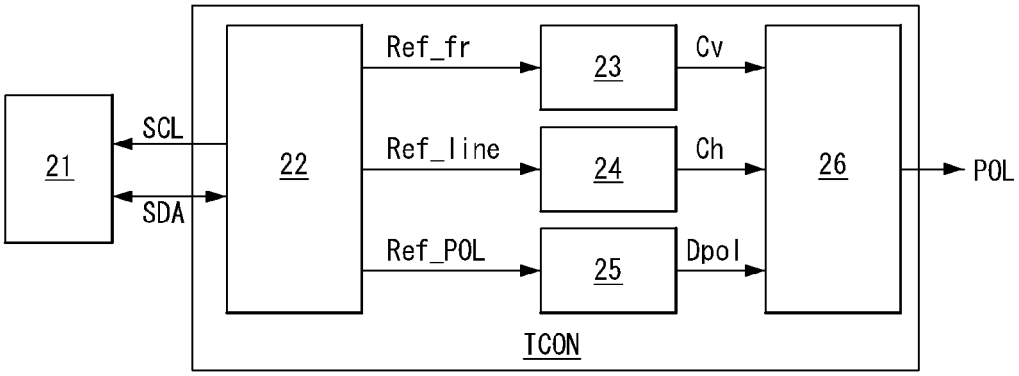
FIG. 2 is a block diagram showing a circuit portion for generating polarity control signals in a timing controller.

FIG. 2 is a block diagram showing a circuit portion for generating polarity control signals in the timing controller TCON.

Referring to FIG. 2, the timing controller TCON includes an $I^2C$ controller 22, a first counter 23, a second counter 24, a register 25, and a polarity control signal generating unit 26.

The $I^2C$ controller 22 receives frame rotation reference information Ref_fr, line rotation reference information Ref_line, and polarity pattern information Ref_POL from an EEPROM 21 through $I^2C$ communication. And, the $I^2C$ controller 22 supplies the frame rotation reference information Ref_fr to the first counter 23, supplies the line rotation information reference information Ref_line to the second counter 24, and supplies the polarity pattern information Ref_POL to the register 25.

Figure 4:
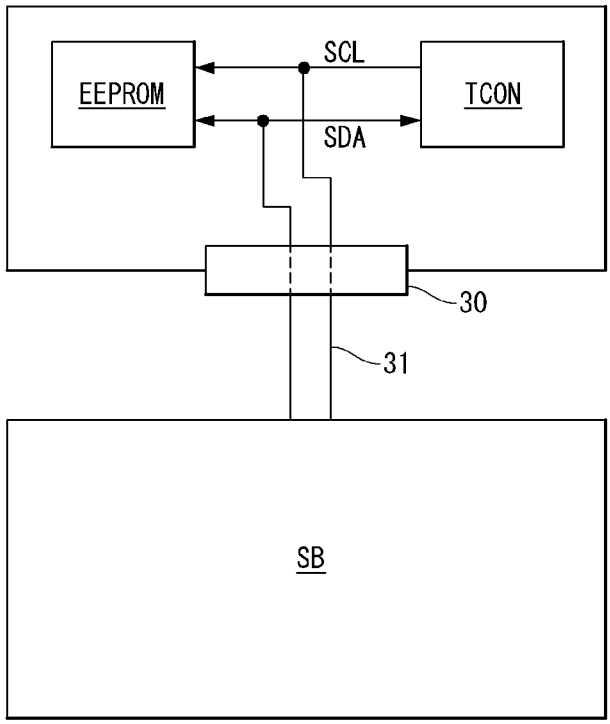
FIG. 4 is a view showing a circuit configuration capable of transmitting the polarity pattern information from a system board to the timing controller.

When the power of the liquid crystal display is turned on, the timing controller TCON receives the frame rotation reference information Ref_fr, the line rotation reference information Ref_line, and the polarity pattern information Ref_POL from the EEPROM 21 through the $I^2C$ controller 22. The $I^2C$ controller 22 transmits a serial clock SCL to the EEPROM 21 and transmits the timing controller TCON receives the frame rotation reference information Ref_line, the line rotation reference information Ref_fr, and the polarity pattern information Ref_POL in the form of serial data SDA to the $I^2C$ controller 22 in accordance with the serial clock SCL. The EEPROM 21 is mounted on the system board SB or the timing controller TCON. The information of the EEPROM 21 may be stored through a ROM writer. The information stored in the EEPROM 21 may be modified, deleted, and added through the ROM writer. The system board SB may be connected to the $I^2C$ controller 22 of the timing controller TCON through a user cable 31 and a connector 30 as shown in FIG. 4. In this case, the $I^2C$ controller 22 is commonly connected to the EEPROM 21 and the system board SB. The $I^2C$ controller 22 transmits a serial clock SCL to the EEPROM 21 and the system board SB, and receives the aforementioned information from the EEPROM 21 or the system board SB. Accordingly, the system board SB or the EEPROM 21 formed on the control board CTRB may control a polarity control signal generated from the timing controller TCON by supplying the timing controller TCON with the reference information for generating a polarity control signal through $I^2C$ communication.

The first counter 23 counts frame periods for which a vertical polarity control signal POL is repeated in accordance with the frame rotation reference information Ref_fr and supplies a frame count value Cv to the polarity control signal generating unit 26. For example, if the frame rotation reference information Ref_fr is input as '010', the first counter 23 counts vertical synchronization signals Vsync or gate start pulses GSP and generates '001' during an odd frame period and '010' in an even frame period so that the vertical polarity control signal POL may be repeated every two frame periods. The frame rotation reference information Ref_fr may be generated as an integer of two or more, and may be generated as a maximum of eight frame rotation information when generated in 3 bits.

The second counter 24 counts lines (or horizontal periods) for which the vertical polarity control signal POL is repeated in accordance with the line rotation reference information Ref_line and supplies a line count value Ch to the polarity control signal generating unit 26. For example, if the line rotation reference information Ref_line is input as '100', the second counter 24 counts horizontal synchronization signals Hsync or data enables signals DE and generates '001' upon receipt of data of a (4*i*+1)-th line (i is a positive integer) and '010' upon receipt of data of a (4*i*+2)-th line so that the vertical polarity control signal POL may be repeated. Also, the second counter 24 counts horizontal synchronization signals Hsync or data enables signals DE and generates '011' upon receipt of data of a (4*i*+3)-th line (i is a positive integer) and '100' upon receipt of data of a (4*i*+4)-th line. The line rotation reference information Ref_line may be generated as an integer of two or more, which is less the number of lines of the liquid crystal display panel, and may be generated as a maximum of eight line rotation information when generated in 3 bits.

The register 25 stores the polarity pattern information input from the I2C controller 21, and selects polarity pattern information Dpol synchronized with the frame count value Cv and the line count value Ch from the polarity pattern information and supplies it to the polarity control signal generating unit 26. If the polarity control signal POL is repeated every two frame periods and four lines are repeated every frame period, the register 25 stores 4-bit polarity pattern information indicating the polarities of four lines, respectively, to be displayed during an odd frame period, and 4-bit polarity pattern information indicating the polarities of four lines, respectively, to be displayed during an even frame period, and supplies 1-bit polarity pattern information synchronized with the frame count value Cv and the line count value Ch to the polarity control signal generating unit 26.

The polarity control signal generating unit 26 detects a frame currently displayed on the liquid crystal display panel 10 based on the frame count value Cv from the first counter 23, and detects a line for displaying current data on the liquid crystal display panel 10 based on the line count value Ch from the second counter 24. In addition, the polarity control signal generating unit 26 inverts the logic of the polarity control signal POL according to the polarity pattern information from the register 25 which is synchronized with the frame count value Cv and the line count value Ch. If the polarity pattern information from the register 25 is '1', the polarity control signal generating unit 26 generates the polarity control signal POL as a high logic. On the other hand, if the polarity pattern information from the register 25 is '0', the polarity control signal generating unit 26 generates the polarity control signal POL as a low logic. The source drive ICs 131 to 136 select a positive polarity data voltage as a data voltage to be supplied to the data lines 14 in response to the polarity control signal POL of high logic, and selects a negative polarity data voltage as a data voltage to be supplied to the data lines 14 in response to the polarity control signal POL of low logic.

FIG. 3 is a view showing an example of setting polarity pattern information of the EEPROM 21 which transmits the polarity pattern information to the timing controller TCON through $I^2C$ communication Referring to FIG. 3, the EEPROM stores polarity pattern information for each frame. The polarity pattern information is stored every line as a logical value of a polarity control signal POL. Since the polarity control signal is repeated every predetermined period, the polarity pattern information is not stored as many as the number of lines of the liquid crystal display panel, but logical values of polarity control signals of 12 lines or less only are stored every frame. The EEPROM transmits as many logical values of the polarity control signals as the number of repetitive frames and the number of repetitive lines to the register 25 of the timing controller TCON under control of the $I^2C$ controller 21. In a case where a polarity control signal POL is generated every two frames and every four lines, the timing controller TCON determines a logical value of the polarity control signal POL in every line of the liquid crystal display panel 10 while repeating four line polarity pattern information "1111" of 1 Frame POL. In FIG. 3, during an even frame period, the timing controller TCON determines a logical value of the polarity control signal POL in every line of the liquid crystal display panel 10 while repeating four line polarity pattern information "1010" of 2 Frame POL. As a result, the logic of the polarity control signal POL is repeated in the order of 1→1→1→1 during a first frame period, and then repeated in the order of 1→0→1→0 during a second frame period. And, the logic of the polarity control signal POL is repeated in the order of 1→1→1→1 during a third frame period, and then repeated in the order of 1→0→1→0 during a fourth frame period.

As described above, the liquid crystal display and the driving method thereof according to the exemplary embodiment of the present invention can define a polarity pattern in the register and control the polarity of a data voltage to be supplied to the liquid crystal display panel. Therefore, the present invention enables it to select an optimum polarity pattern for any problem pattern by adjusting a register value, and requires no large-capacity memory, such as a line memory or frame memory, because a register for defining a problem pattern and a polarity pattern is used.

From the foregoing description, those skilled in the art will readily appreciate that various changes and modifications can be made without departing from the technical idea of the present invention. Therefore, the technical scope of the present invention is not limited to the contents described in the detailed description of the specification but defined by the appended claims.

What is claimed is:

1. A liquid crystal display, comprising:

a liquid crystal display panel including a plurality of data lines, a plurality of gate lines crossing the data lines, and pixels arranged in m×n matrix, where m and n are positive integers;

an EEPROM configured to store frame rotation reference information, line rotation reference information, and polarity pattern information;

a timing controller configured to generate a polarity control signal to control polarities of data voltages charged in the data lines of the liquid crystal display panel based on the information read from the EEPROM; and source drive ICs configured to convert the polarities of the data voltages supplied to the data lines in response to the polarity control signal, wherein the timing controller comprises:

a first counter configured to:

count frame periods for which a vertical polarity control signal is repeated according to the frame rotation reference information from the EEPROM, and output a frame count value, a second counter configured to:

count lines for which the vertical polarity control signal is repeated according to the line rotation reference information from the EEPROM, and output a line count value, a register configured to:

store the polarity pattern information from the EEPROM, select a polarity pattern information synchronized with the frame count value from the first counter and the line count value from the second counter among the polarity pattern information, and output the selected polarity pattern information, and a polarity control signal generating unit configured to:

detect a frame currently displayed on the liquid crystal display panel based on the frame count value from the first counter, detect a line for displaying current data on the liquid crystal display panel based on the line count value from the second counter, and invert a logic of the polarity control signal according to the selected polarity pattern information from the register.

2. The liquid crystal display according to claim 1, wherein the timing controller is further configured to:

repeat the logic of the polarity control signal in units of frame periods according to the frame rotation reference information; and repeat the logic of the polarity control signal in units of lines of the liquid crystal display panel according to the line rotation reference information.

3. The liquid crystal display according to claim 1, further comprising:

a system board configured to transmit digital video data and timing signals to the timing controller through an interface circuit.

4. The liquid crystal display according to claims 1, further comprising an $I^2C$ controller configured to supply the register with the polarity pattern information transmitted from the EEPROM through $I^2C$ communication.

5. A driving method of a liquid crystal display, which is for driving a liquid crystal display panel including a plurality of data lines, a plurality of gate lines crossing the data lines, and pixels arranged in m×n matrix, wherein m and n are positive integers, the method comprising:

storing polarity pattern information, frame rotation reference information, and line rotation reference information on an EEPROM;

generating a polarity control signal to control polarities of data voltages charged in the data lines of the liquid crystal display panel based on the information read from the EEPROM; and converting the polarities of the data voltages supplied to the data lines in response to the polarity control signal, wherein the step of generating the polarity control signal comprises:

counting frame periods for which a vertical polarity control signal is repeated according to the frame rotation reference information from the EEPROM, outputting a frame count value, counting lines for which the vertical polarity control signal is repeated according to the line rotation reference information from the EEPROM, outputting a line count value, storing the polarity pattern information from the EEPROM, selecting a polarity pattern information synchronized with the frame count value the first counter and the line count value the first counter among the polarity pattern information, outputting the selected polarity pattern information, detecting a frame currently displayed on the liquid crystal display panel based on the frame count value from the first counter, detecting a line for displaying current data on the liquid crystal display panel based on the line count value from the second counter, and inverting a logic of the polarity control signal according to the selected polarity pattern information from the register.

6. The method according to claim 5, further comprising supplying the polarity pattern information through $I^2C$ communication.

* * * * *